US005882408A

United States Patent [19]

Fujita

[11] Patent Number: 5,882,408

[45] Date of Patent: Mar. 16, 1999

[54] LIQUID COATING DEVICE

[75] Inventor: Kazuhiko Fujita, Otsu, Japan

[73] Assignee: Toray Engineering Co., Ltd., Osaka, Japan

[21] Appl. No.: 923,583

[22] Filed: Sep. 4, 1997

[30] Foreign Application Priority Data

Sep. 5, 1996 [JP] Japan ..... 8-257620

[51] Int. Cl.[6] ..... B05C 11/00; B05C 3/02

[52] U.S. Cl. ..... 118/684; 118/429; 118/410; 118/602

[58] Field of Search ..... 118/684, 602, 118/410, 429, 300, 325; 425/166, 169, 171, 146; 156/578, 378, 367, 356; 239/124, 126

[56] References Cited

U.S. PATENT DOCUMENTS 3,902,665 9/1975 Hendry ..... 425/467
4,744,330 5/1988 Claassen ..... 118/410
4,831,961 5/1989 Chino et al. ..... 118/410
4,944,903 7/1990 Nilsson ..... 264/40.1

FOREIGN PATENT DOCUMENTS 1-37727 11/1989 Japan .

*Primary Examiner*—David A. Simmons
*Assistant Examiner*—Calvin Padgett
*Attorney, Agent, or Firm*—Burns, Doane, Swecker & Mathis, L.L.P.

[57] ABSTRACT

A coating system of a liquid to a sheet material. The system includes a tank 1, a feed pump 4, a feed control valve 8 including a liquid drawing or sucking back mechanism, and a slit die 9 for applying the liquid to the sheet, which are connected with each other by means of a first, second and a third feed conduits 3, 5 and 7. A first return conduit 11 with a return control valve 10 and a second return conduit 12 are provided between the feed pump 4 and the feed control valve 8 for returning the liquid to the tank 1. Electromagnetic-valves 15 and 17 operated by a control apparatus 22 are provided for switching instantaneously the conduits between the feed control valve and the return control valve 10.

14 Claims, 2 Drawing Sheets

LIQUID COATING DEVICE

BACKGROUND OF THE INVENTION

1. Field of the Invention

The present invention relates to an apparatus for coating a liquid, such as a synthetic resin liquid or a paint on an object to be coated.

2. Description of Related Art

During production of a lithium iron battery, an electrode material, such as graphite, coke or carbon fibers is coated at a predetermined spacing onto a continuous metal foil such as an aluminum foil or copper foil. Furthermore, there are many occasions where a coating of a liquid such as a synthetic resin liquid or paint on a surface of a continuous sheet such as a film of a synthetic resin or a sheet of a paper is required. During an execution of these coating process, a length of the material to be coated is conveyed in a horizontal or a vertical direction by means of a roller member.

Furthermore, when a liquid such as a synthetic resin liquid or a paint is coated onto a surface of a cut length of an object to be coated, such as glass plate or wafer, the cut length of the object to be subjected to coating is conveyed horizontally by means of a belt conveyor or a roller conveyor.

When an object of a continuous length is to be subjected to coating, a slit die apparatus having a slit shaped outlet for the liquid extending along the width of the object to be coated is arranged at a location in front of a back up roller. A bath of the coating liquid is connected to a liquid delivery pipe, so that the liquid from the bath is fed to the slit die via a three way valve. The three way valve is also connected to are turn pipe, which allows excess liquid to be recirculated to the liquid bath.

In the operation the above mentioned coating system, a pump for generating a forced flow of the liquid is always operated, so that the liquid is always forced out. The three way switching valve is switched between an opened position where the liquid is discharged to the slit die and a closed position, where the discharge of the liquid is prevented.

The above system, where a discharge and stoppage of the liquid is done by switching of the three port switching valve between the opened position and the closed position, is defective in that the switching to the closed position to cause the liquid to be returned to the liquid reservoir does not instantly cause the feed of the liquid to be stopped, which results in an occurrence of a so-called a "post drop", which can cause a starting edge portion or finishing edge portion of the coating to be unsharp. Furthermore, when the liquid reservoir chamber is at atmospheric pressure, switching of the three way valve to a position where the liquid is returned to the reservoir causes the pressure to drop at the liquid feed pipe. Thus, after a subsequent switching of the three way valve to a position where the liquid is fed to the feed pipe, a stable discharge of the liquid from the slit die can not be obtained until the pressure of the liquid at the feed pipe is increased to a predetermined value, thereby causing the quality of the coating to be insufficient or poor.

SUMMARY OF THE INVENTION

An object of present invention is to provide a coating apparatus capable of preventing an occurrence of a post dropping.

Another object of the present invention is to provide a coating apparatus, capable of obtaining a sharp starting or finishing edge of the coating.

Further another object of the present invention is to provide a coating apparatus capable of ejecting the liquid from a slit die immediately after the switching of the passageways.

According to the present invention, a liquid coating system is provided, comprising:

a slit die for applying a liquid to an object to be coated;

a tank for a liquid;

a feed conduit for connecting the tank with the slit die;

a feed pump arranged on the feed conduit to supply the liquid to the slit die;

a feed control valve arranged in the feed conduit at a location between the feed pump and the slit die, said feed control valve having a liquid drawing back means;

a return conduit for connecting the feed conduit at a location between the feed pump and the feed control valve with said tank;

a return control valve arranged on the return conduit, and;

means for obtaining a substantially instantaneous switching between the feed conduit and the return conduit by said feed control valve and the return control valves.

According to this structure, the post dropping phenomenon is prevented, which allows the edge of the coating to be sharp when the coating is started or finished.

Advantageously, the system is further provided with a pressure control valve on said return conduit and a pressure sensor located between the liquid feed pump and said pressure control valve or between said liquid pump and said feedcontrol valve. By this structure, the switching operation instantly causes the liquid to be discharged from the slit die under a stabilized condition, thereby obtaining an uniform thickness of the coating along the entire length of the coating.

Advantageously, the system is further provided with means for controlling said pressure control valve so that a predetermined pressure detected by said pressure sensor is obtained. By this structure, apositive and a stable discharge of the liquid is obtained.

BRIEF EXPLANATION OF ATTACHED DRAWINGS

DESCRIPTION OF A PREFERRED EMBODIMENT

Figure 1:
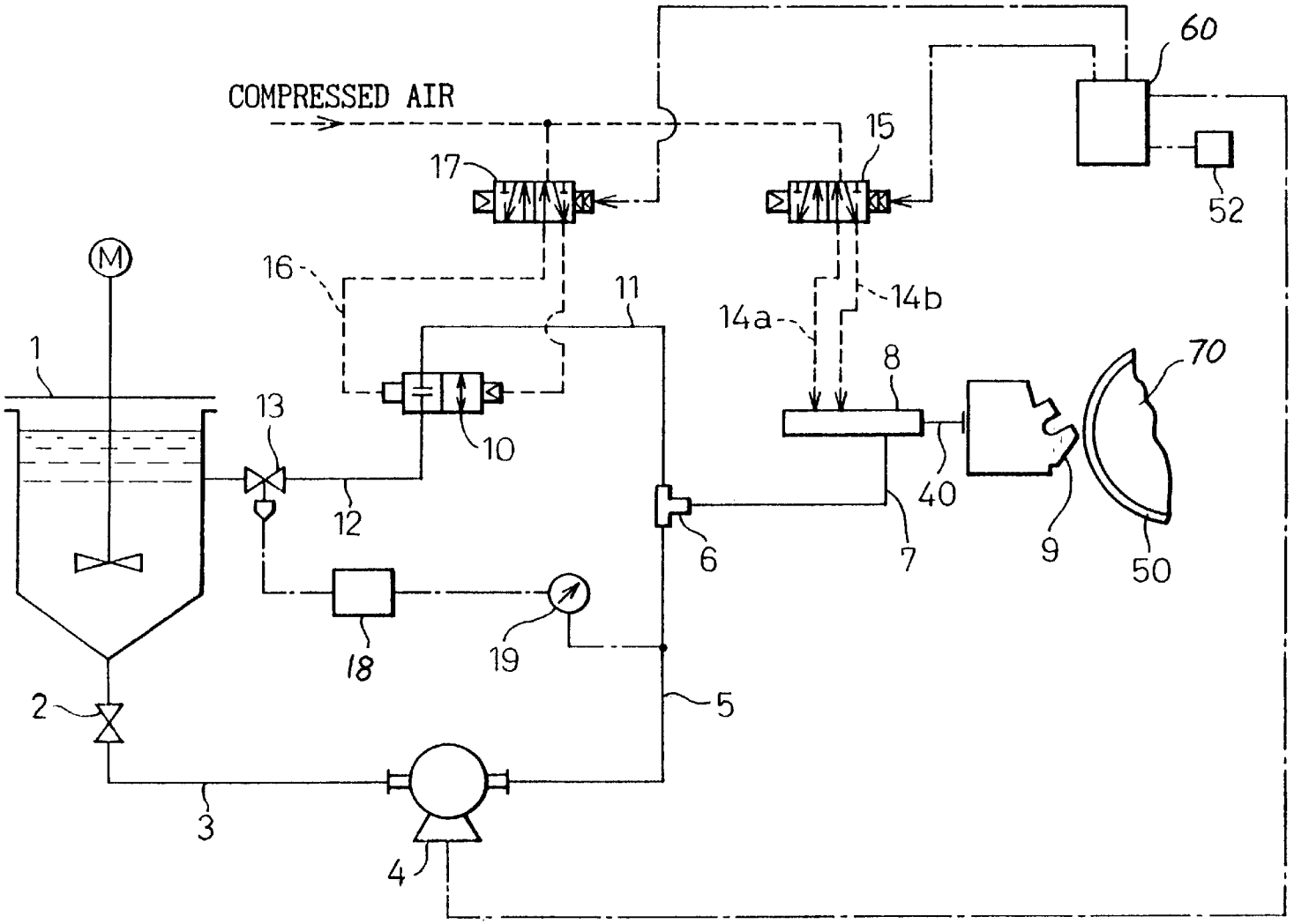
FIG. 1 is a schematic view of a coating system according to present invention.

Now, an embodiment of a coating apparatus according to the present invention will be explained with reference to FIG. 1, which shows a schematic view of a coating system according to present invention. In FIG. 1, the coating system includes a reservoir tank 1 and a control valve 2. A first liquid feed conduit 3 is, at its end, connected to the reservoir tank 1 at its bottom portion. The control valve 2 is arranged on the first feed conduit 3 at a location adjacent the reservoir tank 1. The first feed conduit 3 has a downstream end, to which a liquid feed pump 4 is, at its inlet, connected. The system is further provided with a second liquid feed conduit 5 having an upstream end connected to the outlet of the liquid feed pump 4. Connected to the downstream end of the second liquid feed conduit 5 is a T-shaped connector 6, which has an intermediate part connected to a third feed conduit 7 at its upstream end. The third feed conduit 7 has a downstream end connected, via a feed control valve 8, to the slit die 9 which is arranged to face a drum 70 on which a sheet material 50 to be coated is moved. Namely, the slit die 9 is moved, from a rest position, to an operating position where a liquid from the slit die 9 can be coated onto the sheet material 50. The slit die 9 is subjected to a reciprocal movement between the rest position and the operating position, which allow the liquid to be applied to the surface of the sheet material 50 at a predetermined spacing.

A reference numeral 10 denotes a return control valve having a first end connected to a first return conduit 11 which is connected to the T-shaped connector 6 and a second end connected to a second return conduit 12 which is connected to the liquid tank 1. A pressure control valve 13 is located in the second return conduit 12. Desirably, a connection point for the second return pipe 12 to the tank 1 is located at a position below the level of the liquid in the tank 1, so that the liquid from the pipe 12 is returned to the tank 1 in the body of the liquid in the tank 1.

A first electromagnetic valve 15 is for controlling a pneumatic pressure in the feed control valve 8 and is moved between a first position where a pneumatic pressure from a source is opened to the feed control valve 8 and a second position where the air in the feed control valve 8 is removed. A second electromagnetic valve 17 is for controlling a pneumatic pressure in the return control valve 10 and is moved between a first position where a pneumatic pressure from a source is opened to the return control valve 10 and a second position where the air in the return control valve 10 is removed.

A control circuit 60 is for controlling the operation of the first and second electromagnetic valves 15 and 17. The control circuit 60 is connected to a sensor 52 for detecting the amount of the movement of the sheet material 50. Namely, when a coating of the liquid onto the sheet is done, the electromagnetic valve 15 is operated, so that the pneumatic pressure is opened to the feed control valve 8, so that the liquid is applied to the sheet material 50 on the drum 23, while the electromagnetic valve 10 is de-energized, so that the pneumatic pressure in the valve 10 is removed, so that the return control valve 10 closes the return conduit, thereby blocking the flow of the liquid in the return conduit. Contrary to this, when a coating of the liquid onto the sheet is stopped, the electromagnetic valve 15 is de-energized, so that the pneumatic pressure is removed from the feed control valve 8, thereby preventing the liquid from being applied to the sheet material 50, while the electromagnetic valve 17 is energized, so that the pneumatic pressure is applied to the return control valve 10, so that the return control valve 10 opens the return conduit, thereby allowing the liquid to be returned to the tank 1.

The control circuit 60 is provided with a timer or a counter for counting a number of pulses corresponding to the rotating movement of the drum 70 for moving the sheet 50. A separate switching control of the feed control valve 8 and the return control valve 10 is done by the controller 60 in accordance with a signal from the timer or the counter.

A pressure measuring device 19 connected to the second liquid feed conduit 5 for detecting the pressure of the liquid at the second feed conduit 5. A pressure setter 18 is provided for storing a desired setting of the pressure and for controlling the degree of the opening of the pressure control valve 13 so that the pressure in the conduit 5 detected by the pressure measuring device 19 conforms to the pressure set by the setter 18. The pressure measuring device 19 can be mounted to the third feed conduit 7. However, it is desirable that the pressure measuring device 19 is mounted on the second feed conduit 5. The pressure measuring device 19 can integrate a function for storing the desired setting of the pressure and a function for controlling the pressure. In this latter case, the pressure setter 18 can be eliminated.

In the liquid storage tank 1, it is possible that a mixing device for mixing the liquid in the tank 1 as well as a device for detecting the liquid level meter in the tank may be provided. Furthermore, conduits can be connected to the tank for feeding a inert gas for preventing a liquid being degraded and for feeding compressed air for controlling the pressure inside the tank 1.

In case where it is necessary that the pressure of the liquid is maintained at a predetermined value, the parts such as the liquid storage tank 1 and the liquid feed conduits and the return conduits as well as the slit die can be provided with outer jackets to which a heating medium or cooling medium is stored to obtain thermal insulation of these parts.

It should be noted that the feed control valve 8 and the return control valve should be a fast response type.

Figure 2:
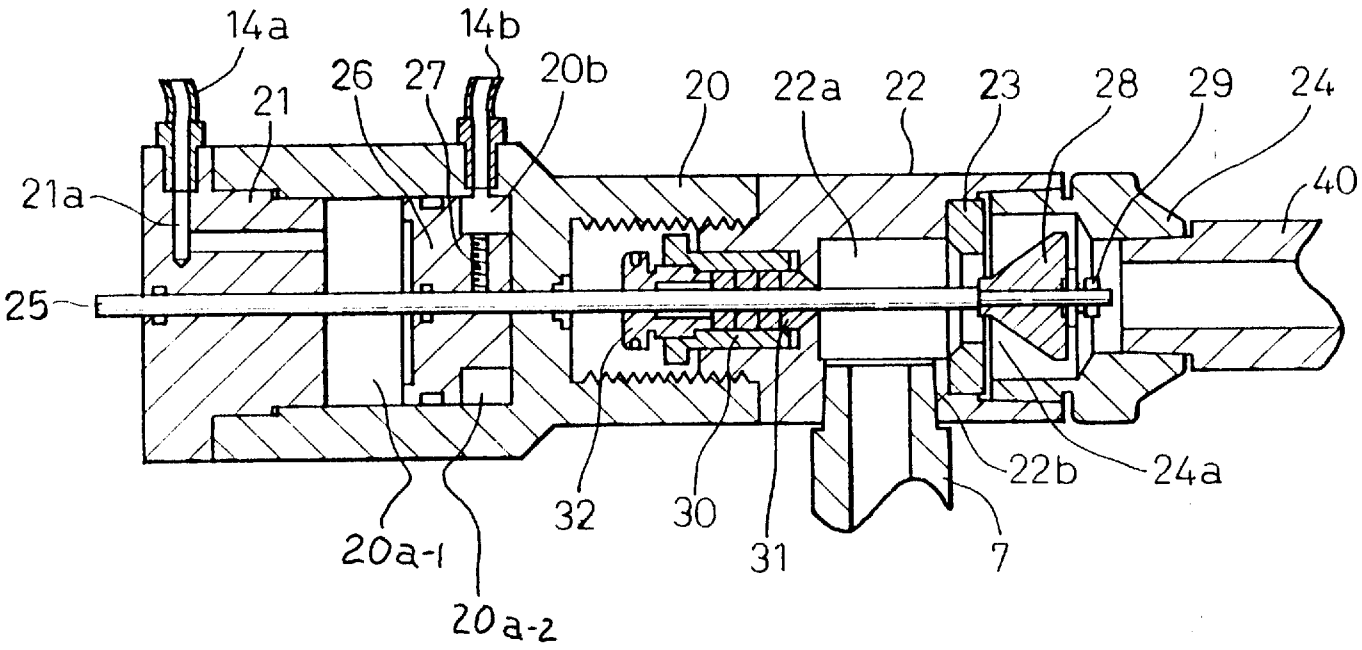
FIG. 2 is a cross sectional view of a feed control valve in FIG. 1.

As shown in FIG. 2, the feed control valve 8 has a casing which is constructed by a first valve casing 20 closed at its one end by a plug member 21 and a second valve casing 22 connected to the other end of the first casing 20. A valve seat member 23 is arranged on a first end of the second valve housing 22 and is fixedly connected to the housing 22 by means of a sleeve 24, so that a liquid feed chamber **22*a* is formed on the side of the valve seat 23 adjacent the valve casing 22. The chamber 22*a* is connected to the liquid feed conduit 7, while the sleeve 24 is connected to a conduit 40 to the slit die 9. A valve rod 25 extends along the length of the casing, and a piston 26 is arranged in the first casing 21 so as to be axially reciprocated, while piston chambers 20*a*-1 and 20*a*-2 are formed in respective sides of the piston 26. The valve rod 25 is slidable with respect to the plug member 21, while being fixedly connected to the piston 26 by means of a set screw 27. A valve member 28 is arranged in the sleeve 24 so that the valve member 28 faces the valve seat member 23, while the valve member 28 is fixedly connected to the valve rod 25 by means of a nut 29. A seal assembly is provided, which is constructed by a seal case 30 arranged around the valve rod and screwed to the second valve case 22, a series of packing members 31 of a disk shape, and a packing holder 32 for urging the packing members 31 so that they are firmly held with each other, while a desired sealing of the liquid is obtained. Inside the sleeve, a liquid storage chamber 24*a* is formed between the valve seat 23 and the valve member 28. The plug 21 is formed with an opening 21*a* which is opened to a first piston chamber 20*a*-1 and a first pneumatic pressure feed conduit 14*a* is connected to the opening 21*a*, so that the pneumatic pressure is opened to the chamber 20*a*-1. In the similar way, the first casing 20 is formed with an opening 20*b*, which is connected to the second pneumatic pressure conduit 14*b***.

When the electromagnetic valve 15 in FIG. 1 is switched to a position where the pneumatic pressure is opened to the first conduit **14*a*, the piston 26 is moved in the right-hand direction in FIG. 2, so that the valve member 28 is moved away from the valve seat 23, which allows the liquid in the feed conduit 7 to be, via the chamber 24*a*, introduced into the conduit 40 to the slit die 9. Contrary to this, when the electromagnetic valve 15 in FIG. 1 is switched to a position where the pneumatic pressure is opened to the second conduit 14*b*, the piston 26 is moved in the left-hand direction in FIG. 2, so that the valve member 28 is moved toward the valve seat 23, which prevents the liquid in the feed conduit 7 from being introduced into the slit die 9**.

By such a movement of the valve member 28 toward the valve seat 23 when a flow of the liquid to the slit die 9 is blocked, the valve member 28 of a shape tapered toward the valve seat 23 causes the liquid to be pushed back from the liquid storage chamber 24*a* to the feed chamber 22*a*,which causes the pressure to be reduced at the conduit 40 to the slit die 9. As a result, a drawing back or sucking function of the liquid from the slit die 9 is obtained simultaneously with the switching operation of the control valve 8.

Finally, in case of the construction of the slit die 9 which is moved between operating position for discharging a liquid and a rest position, it is desirable that a part or all of the part of the liquid feed conduit is made of a flexible material such as rubber.

Now, an operation of the coating device according to the present invention will be explained.

First, a predetermined amount of liquid for a coating is fed to the liquid tank 1. Then, the control valve 2 is moved to an opened condition for allowing the liquid to be discharged to the first feed conduit 3. Furthermore, the electromagnetic valve 15 is operated to open the conduit 14*a*, which causes the feed control valve 8 to be opened, while the electromagnetic valve 17 is operated, which causes the return control valve 10 to be closed. In this condition, the liquid feed pump 4 is operated, so that the liquid is fed to the slit die 9, which causes the liquid to be continuously ejected from the slit die 9 and to be received by a tray. As a result of an execution of this preparatory operation, any air possibly remaining in any of the feed conduits 3, 5 and 7 and the slit die 9 can be removed.

Under such a continuous ejecting condition of the liquid from the slit die, a pressure of the liquid is detected by a pressure detecting device 19 and the detected value is directly input to the setter device 18 and is stored therein. As a alternative, an introduction of such a predetermined value to the setter 20 can be manually done by an operator by manually reading the value indicated by the pressure detecting device 19.

Then, the electromagnetic valve 15 is operated for causing the feed control valve 8 to be closed, while the electromagnetic valve 17 is operated for causing the liquid return control valve 10 to be opened. Furthermore, in accordance with the signal from the pressure setter 18, the pressure of the liquid subjected to the returning to the tank 1 is controlled to a value which is identical to the pressure of the liquid during the discharged condition of the liquid from the slit die 9.

After the completion of the above preparatory steps, the liquid outlet nozzle of the slit die 9 is moved to a position where the nozzle is faced with the sheet material 50 to be coated by the liquid and driven by the drum 70. Then, the control device 60 issues electric signals to the electromagnetic valves 15 and 17 in such a manner that the electromagnetic valve 17 is operated to close the liquid return control valve 10, while the electromagnetic valve 15 is operated, simultaneously, to open the liquid feed control valve 8, which causes the liquid to be discharged from the slit die and to be applied to the sheet material 50.

When a predetermined length of the coated liquid is obtained on the sheet material 50, the control device 60 issues electric signals to the electromagnetic valves 15 and 17 in such a manner that the electromagnetic valve 15 is operated to close the liquid feed control valve 8, while the electromagnetic valve 17 is operated to open the liquid return control valve 10, which causes the discharge of the liquid from the slit die to cease.

When the electromagnetic valve 15 is operated so that the feed of the pneumatic pressure is switched from the port 21*a* to 20*b* for switching the feed control valve 8 to a closed position, the piston 26 together with the valve member 28 are moved in the left-hand direction in FIG. 2. Such a movement of the valve member 28 causes the liquid in the storage chamber 24*a* to be drawn back to the feed chamber 22*a*, which causes the pressure at the conduit 40 to the slit die 9 to be reduced. Thus, the liquid in the outlet nozzle of the slit die 9 is drawn back to the feed side of the liquid. Due to such a drawn back action, the post dropping of the liquid does not occur, thereby obtaining a sharp edge at the coated portion on the sheet when the coating is finished. Furthermore, storage of the liquid at the outlet of the slit die does not occur, which would otherwise cause a droplet of liquid is be projected outwardly from the nozzle end of the slit die. Since such projection does not occur, a sharp edge is formed at the coated portion when the following coating operation is commenced. The liquid discharged by the feed pump 4 is, due to the opened condition of the return control valve 10, returned back to the storage tank 1.

When a predetermined time has elapsed or a predetermined pulse number has been counted, the electromagnetic valve 17 is operated, so that the return control valve 10 is closed and, simultaneously, the electromagnetic valve 15 is operated so the feed control valve 8 is opened, which allows the liquid to be, again, discharged from the slit die 9, thereby restarting the coating of the liquid on the sheet material 50.

In the above operation, the timing of the operation of the feed control valve 8 and the return control valve is basically simultaneous. Namely, a switching to an opened condition of the feed control valve 8 and to a closed condition of the return control valve 10 and a switching to a closed condition of the feed control valve 8 and to an opened condition of the return control valve 10 occur substantially simultaneously. However, it is possible that the switching to an opened condition of the feed control valve 8 is delayed with respect to the switching to the closed condition of the return control valve 10 for a very short time in a range of a few of ten to a few of hundreds milliseconds, advantageously in a range of 50 to 200 milliseconds, which allows the linearity to be increased when the coating is commenced.

I claim:

1. A liquid coating system comprising:

a slit die for applying a liquid to an object to be coated;

a tank for a liquid;

a feed conduit for connecting the tank with the slit die;

a feed pump arranged on the feed conduit for a supply of the liquid to the slit die;

a feed control valve arranged on the feed conduit at a location between the feed pump and the slit die for movement between open and closed positions, said feed control valve having liquid drawing back means for allowing the liquid to be drawn back from the slit die as the feed control valve is moved to its closed position;

a return conduit branching from the feed conduit at a location between the feed pump and the feed control valve, said return conduit being connected to said tank;

a return control valve arranged on the return conduit, and;

means for controlling the feed control valve and the return control valve for obtaining a substantially instantaneous switching between the feed conduit and the return conduit.

2. A liquid coating system according to claim 1, wherein said means for controlling the contolling feed control valve and the return control valve so that opening of the feed control valves is delayed with respect to closing of said return control valve.

3. A liquid coating system according to claim 1, further comprising a pressure control valve on said return conduit between said tank and said return control valve, and a pressure sensor located between the feed pump and said pressure control valve or between said feed pump and said feed control valve.

4. A liquid coating system according to claim 3, further comprising means connected to said pressure control valve for controlling said pressure control valve so that a predetermined pressure, detected by said pressure sensor, is obtained.

5. A liquid coating system comprising:

a slit die for applying a liquid to an object to be coated;

a tank for a liquid;

a feed conduit connecting the tank with the slit die;

a feed pump arranged on the feed conduit for pumping liquid to the slit die;

means arranged on the feed conduit at a location between the feed pump and the slit die for movement between an open position for permitting liquid flow to the slit die and a closed position for preventing liquid flow to the slit die and for also drawing back liquid from the slit die during movement to the closed position, said means including a valve member;

a return conduit connected to the feed conduit and the tank;

a return control valve arranged on the return conduit; and means for controlling the feed control valve and the return control valve for switching between the feed conduit and the return conduit.

6. A liquid coating system according to claim 5, wherein said means for controlling controls the feed control valve and the return control valve so that opening of the feed control valves is delayed with respect to closing of said return control valve.

7. A liquid coating system according to claim 5, further comprising a pressure control valve on said return conduit between said tank and said return control valve, and a pressure sensor located between the feed pump and said pressure control valve or between said feed pump and said feed control valve.

8. A liquid coating system according to claim 7, further comprising means connected to said pressure control valve for controlling said pressure control valve so that a predetermined pressure, detected by said pressure sensor, is obtained.

9. A liquid coating system according to claim 5, wherein said means arranged on the feed conduit further includes a valve casing and a valve seat member with which said valve member cooperates when in the closed position.

10. A liquid coating system comprising:

a slit die for applying a liquid to an object to be coated;

a tank for a liquid;

a feed conduit for connecting the tank with the slit die;

a feed pump arranged on the feed conduit for a supply of the liquid to the slit die;

a feed control valve arranged on the feed conduit at a location between the feed pump and the slit die for movement between open and closed positions to control liquid flow to the slit die, said feed control valve including liquid drawing back means for drawing back liquid from the slit die as the feed control valve is moved to the closed position;

a return conduit branching from the feed conduit at a location between the feed pump and the feed control valve, said return conduit being connected to said tank;

a return control valve arranged on the return conduit;

means for controlling the feed control valve and the return control valve to switch between the feed conduit and the return conduit;

a pressure control valve on said return conduit between said tank and said return control valve; and a pressure sensor located between the feed pump and said pressure control valve or between said feed pump and said feed control valve.

11. A liquid coating system according to claim 10, wherein said means for controlling controls the feed control valve and the return control valve so that opening of the feed control valves is delayed with respect to closing of said return control valve.

12. A liquid coating system according to claim 10, including a pressure setter connected to the pressure sensor for setting a pressure and connected to the pressure control valve for controlling a degree of opening of the pressure control valve.

13. A liquid coating system according to claim 10, further comprising means connected to said pressure control valve for controlling said pressure control valve so that a predetermined pressure, detected by said pressure sensor, is obtained.

14. A liquid coating system according to claim 10, wherein said feed control valve includes a valve casing, a valve member movable within the valve casing and a valve seat member with which said valve member cooperates when in the closed position.

* * * * *